US006283804B1

(12) United States Patent
Weingartner

(10) Patent No.: US 6,283,804 B1
(45) Date of Patent: Sep. 4, 2001

(54) CABLE CONNECTOR FOR ELECTRICAL CONNECTIONS

(75) Inventor: Bernhard Weingartner, Feldkirch (AT)

(73) Assignee: Neutrik Aktiengesellschaft, Fuerstentum (LI)

( * ) Notice: Subject to any disclaimer, the term of this patent is extended or adjusted under 35 U.S.C. 154(b) by 0 days.

(21) Appl. No.: 09/563,619

(22) Filed: May 2, 2000

(30) Foreign Application Priority Data

May 7, 1999 (DE) ..... 199 21 132

(51) Int. Cl.[7] ..... H01R 4/50
(52) U.S. Cl. ..... 439/864
(58) Field of Search ..... 439/864, 463, 439/460, 610, 581, 417; 174/65 R

(56) References Cited

U.S. PATENT DOCUMENTS

| | | | | |
|---|---|---|---|---|
| 4,153,326 | | 5/1979 | Frantz et al. | 339/99 |
| 4,323,725 | * | 4/1982 | Muller | 174/65 R |
| 4,556,275 | * | 12/1985 | Hamsher | 439/581 |
| 4,607,905 | * | 8/1986 | Vaden | 439/864 |
| 4,664,467 | * | 5/1987 | Tengler et al. | 439/864 |

FOREIGN PATENT DOCUMENTS

| | | | |
|---|---|---|---|
| 83 391 | | 7/1971 | (DE) . |
| 27 00 197 | | 7/1977 | (DE) . |
| 28 43 628 | | 5/1979 | (DE) . |
| 0633627 | * | 11/1995 | (EP) . |
| 2 261 775 | | 5/1993 | (GB) . |

* cited by examiner

*Primary Examiner*—Paula Bradley
*Assistant Examiner*—Briggitte R. Hammond
(74) *Attorney, Agent, or Firm*—Reed Smith LLP

(57) ABSTRACT

The cable connector for electrical connections has a connector housing and a connector insert which is made of electrically insulating material and has contact elements, and a pull relief for the cable to be connected. This pull relief is formed by a swivel jaw. The surface of the swivel jaw cooperating with the cable is rounded in an arc-shaped manner and is formed with teeth. The swivel plane of the swivel jaw lies in or parallel to the longitudinal axis of the cable connector. The connector insert is formed of at least two parts, wherein the first part has a portion having the contact elements and a channel-like portion adjoining the rear side of portion, with an electrically conducting insert extending along part of the length of the channel-like portion. This electrically conducting insert extends until the portion of the first part having the contact elements to form a ground contact. The other, second part of the connector insert is connectable with the channel-like portion of the first part. The swivel jaw is supported at this second part.

18 Claims, 3 Drawing Sheets

CABLE CONNECTOR FOR ELECTRICAL CONNECTIONS

BACKGROUND OF THE INVENTION a) Field of the Invention

The invention is directed to a cable connector for electrical connections.

b) Description of the Related Art

Cable connectors are used for electrical and mechanical connection between an open, movable cable and a mating connector that is stationary or that is also connected with a cable. Aside from a flawless electrical contact and the mechanical connection of the connectors to be coupled, it is very important that the cable is solidly anchored mechanically in the cable connector. This anchoring must absorb all of the forces occurring between the connector housing and the cable, i.e., it must prevent relative movement between the connector housing and cable when the cable is let in. Above all, this is a matter of transferring the tensile stresses introduced via the cable directly to the connector housing and keeping them away from the mechanical connections of the inner conductors of the cable and the contact elements of the connector, i.e., so that the latter are not mechanically loaded by the above-mentioned tensile stresses. A further object to be met by a strain relief or pull relief of this kind is a simple mounting of the connector on the cable, the fastening of the connector with the fewest possible number of parts. As a rule, a cable connector comprises a housing which is preferably made of metal for reasons pertaining to shielding, a contact element carrier which is made of electrically insulating plastic and which is to be received by the housing, and a pull relief device which absorbs tensile and bending forces acting on the cable, conducts these forces to the connector housing and keeps them away from the contact element insert. In their commonest construction form, the contact elements are constructed as pins or as conjugating, springing sockets which are inserted into the contact element carrier. The mechanical, generally lockable, connection of a connector of this kind with the mating connector can be carried out in various ways, e.g., by means of a locking jack mechanism, a coupling ring or also, with respect to force, by the arrangement of corresponding spring elements.

Various constructional measures, e.g., screw straps, screw clamps, collet chucks, positive-locking cable anchoring by means of a twisting arrangement of the cable and the like, are provided for the above-mentioned pull relief which should advantageously be effective for a certain range of diameters.

In this context, particularly with respect to the pull relief mentioned above, reference is had to the previously known constructions according to DDR 83 391, DE 28 43 628 A1 or GB 2 261 775, all of which show and describe swiveling jaws which form the pull relief by contacting the cable inserted into the cable connector. In the construction according to DDR 83 391, mentioned above, a plurality of swiveling jaws of this type are connected with one another via a deformable ring or ring segment and the construction element designed in this way lies exposed in the housing of the cable connector. When assembling, care must be taken to insert this structural component part in the correct position so that it can perform its intended function. It is also necessary to be careful not to lose this structural component part when assembling, since this structural component part is arranged loosely in the housing. The toothed washer used as pull relief in DE 28 43 628 A1 has an elaborately shaped form which is received in a likewise elaborately shaped bearing by means of a spring pin and a clamping pin. The construction known from GB 2 261 775 A shows bracket-like bent jaws which are provided in pairs and which are connected with one another by one end via a laterally arranged crosspiece. This pull relief requires a relatively large width and is therefore only usable within limits, in particular only in combination with electrical devices which are outfitted with cables, but not in cable connectors under very cramped conditions.

Further, a two-part plug-in connector is known from DE 27 00 197 A1. Its first part has a portion receiving contact elements and an adjoining shell-shaped portion. The second part can be connected with the shell-shaped portion of the first part to form the complete connector. The second part has clamping ribs for cable pull relief.

OBJECT AND SUMMARY OF THE INVENTION

It is the primary object of the invention to suggest a cable connector for electrical connections which is easy to assemble and comprises relatively few parts in a compact construction.

In accordance with the invention, a cable connector for electrical connections has a connector housing and a connector insert which is made of electrically insulating material and has contact elements, and a pull relief for the cable to be connected. This pull relief is formed by a swivel jaw. The surface of the swivel jaw cooperating with the cable is rounded in an arc-shaped manner and is formed with teeth. The swivel plane of the swivel jaw lies in or parallel to the longitudinal axis of the cable connector. The connector insert is formed of at least two parts, wherein the first part has a portion having the contact elements and a channel-like portion adjoining the rear side of portion, with an electrically conducting insert extending along part of the length of the channel-like portion. This electrically conducting insert extends until the portion of the first part having the contact elements to form a ground contact. The other, second part of the connector insert is connectable with the channel-like portion of the first part. The swivel jaw is supported at this second part.

To illustrate the invention, embodiment examples will be explained more fully with reference to the drawing without the invention being limited to these shown embodiment examples.

DESCRIPTION OF THE PREFERRED EMBODIMENTS

In all Figures, identical parts or parts having the same function are provided with the same reference numbers.

Figure 1:
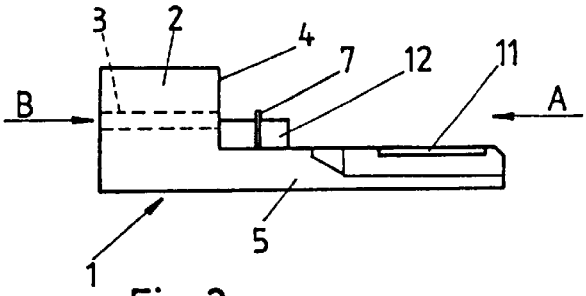
FIG. 1 shows a side view.
Figure 6:
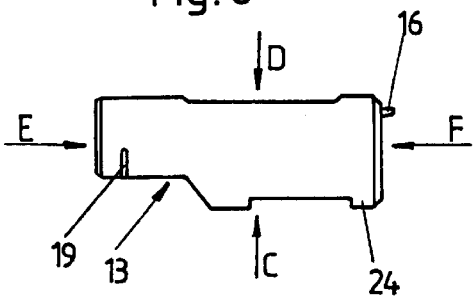
FIG. 6 shows a side view.
Figure 2:
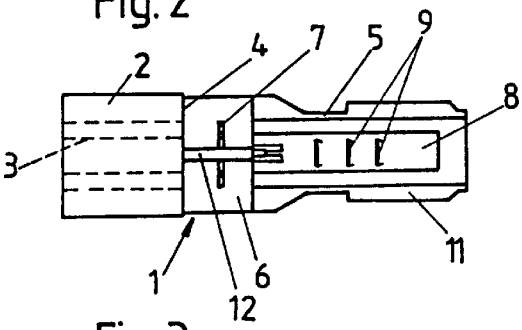
FIG. 2 shows a top view.
Figure 7:
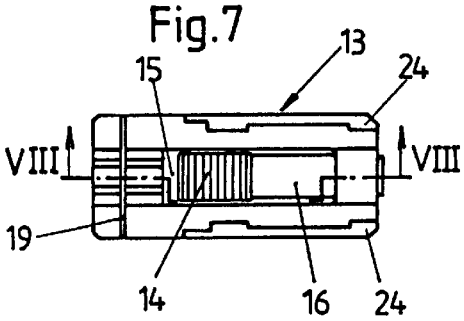
FIG. 7 shows a bottom view in the viewing direction indicated by arrow C in FIG. 6.
Figure 3:
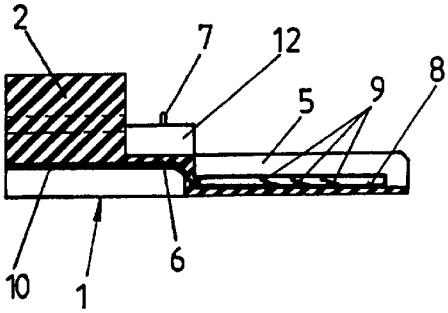
FIG. 3 shows a longitudinal section.
Figure 8:
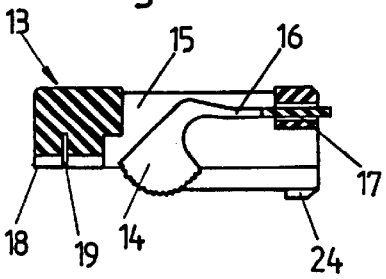
FIG. 8 shows a longitudinal section along line VIII—VIII in FIG. 7.
Figure 9:
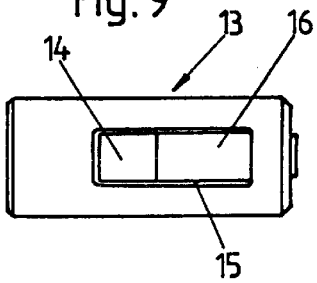
FIG. 9 shows a top view in the viewing direction indicated by arrow D in FIG. 6.

The first part 1 of the two-part connector insert has a portion 2 with electrical contact elements 3 which are formed in this case as sockets, for example. A groove-like or channel-like portion 5 adjoins the rear side 4 of portion 2, wherein a ramp-like projection 6 is provided in the transitional area and carries slotted connection plates 7 which form the rear ends of the contact elements 3 to which the strands of the cable to be connected are to be fastened. These connection plates 7 are disposed essentially at right angles to the longitudinal axis of part 1. An insert 8 of electrically conducting material is arranged in the channel-like portion 5. This electrically conducting insert 8 has raised notches 9 or impressions transverse to its longitudinal direction, wherein these notches 9 or impressions have a wedge angle ascending from the plane of the insert 8, the ascending slope of the wedge angles which follow one another in a longitudinal row being directed against the portion 2 having the contact elements 3 (FIG. 3). Further, this insert has a tongue-like continuation 10 which projects into the portion 2 having the contact elements 3 and forms the ground contact. At the edges and outer sides, guide strips 11 are formed integral with the channel-like portion 5. The channel-like portion 5, together with the ramp-like projection 6, is considerably longer than the portion 2 having the contact elements 3. An insulation web 12 is provided in this case between the two connection plates 7.

The second part 13 of the two-part connector insert is formed in a channel shape along most of its length. It is used as a carrier for the swivel jaw 14. The surface of this swivel jaw 14 cooperating with the cable, not shown, is rounded in an arc-shaped manner and is provided with teeth in addition. This second part 13 of the connector insert has an axially parallel elongated opening 15 whose width is somewhat greater than the width of the swivel jaw 14 that is partially received by this elongated opening 15. The swivel jaw 14 carries a continuation 16 which extends essentially parallel to the longitudinal axis of the cable connector and which is received by a slit-like opening 17 in the second part 13 of the connector insert, which slit-like opening 17 corresponds to the cross section of the continuation 16. This continuation 16 is directed against the rear side of the connector insert. This continuation 16 of the swivel jaw 14 is supported so as to be displaceable in the opening 17 receiving it. The essentially channel-like second part 13 with the swivel jaw 14 supported on it has, at the side facing the portion 2 having the contact elements 3, a cross section-filling shoulder 18 which, in this case, has a slit 19 extending transverse to the channel-like part 13, the slotted connection plates 7 projecting into this slit 19 when the two parts 1 and 13 are joined together per operating instructions. A cutout is also provided in this cross section-filling shoulder 18 for receiving the insulation web 12.

Figure 15:
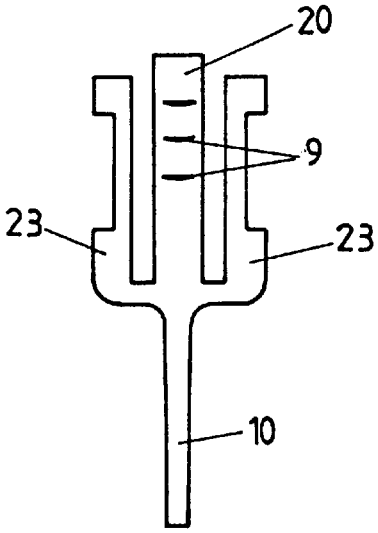
FIGS. 15 and 16 show two embodiment forms of the electrically conducting insert for the ground contact.
Figure 16:
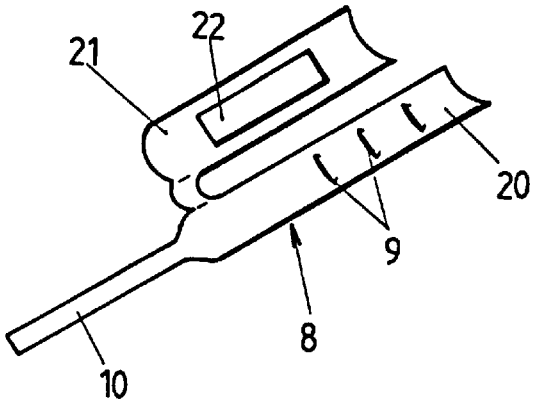

While the electrically conducting insert 8 in the first part 1, according to FIGS. 1 to 5, of the two-part connector insert is essentially strip-shaped, FIG. 16 shows another embodiment form for an insert 8 of this kind in an oblique view. This insert 8 according to FIG. 16 comprises two cylindrical shells 20 and 21 which are connected with one another and are swivelable relative to one another about their longitudinal axis to form a tubular portion, wherein the notches 9 or impressions are formed in one shell 20 and an elongated opening 22 is cut out of the other shell 21 to allow the passage of the swivel jaw 14. In the embodiment example according to FIG. 15, the second shell comprises two parts in practice, wherein the two shell halves 23 are arranged symmetric to the center part with the notches 9.

Figure 4:
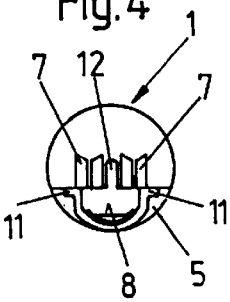
FIG. 4 shows a view in the viewing direction indicated by arrow A in FIG. 1.
Figure 5:
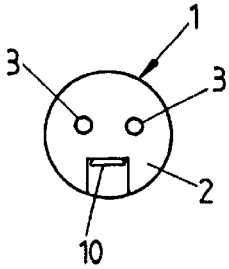
FIG. 5 shows a second view in the viewing direction indicated by arrow B in FIG. 1 of the first part of the connector insert.
Figure 10:
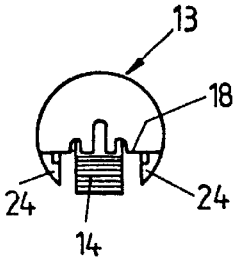
FIG. 10 shows a view in the viewing direction indicated by arrow E in FIG. 6.
Figure 11:
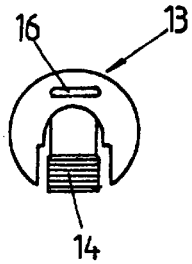
FIG. 11 shows a second view of the second part of the connector insert in the viewing direction indicated by arrow F in FIG. 6.
Figure 12:
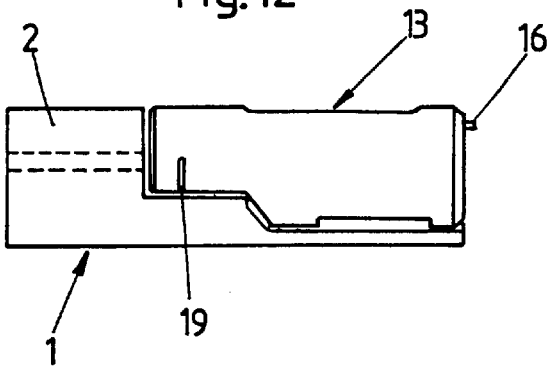
FIG. 12 shows the two-part connector insert from the side.
Figure 13:
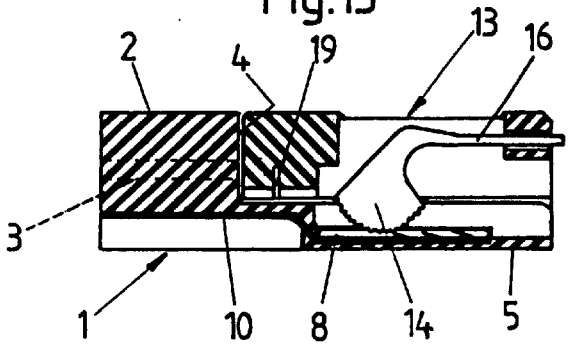
FIG. 13 shows the two-part connector insert in longitudinal section.
Figure 14:
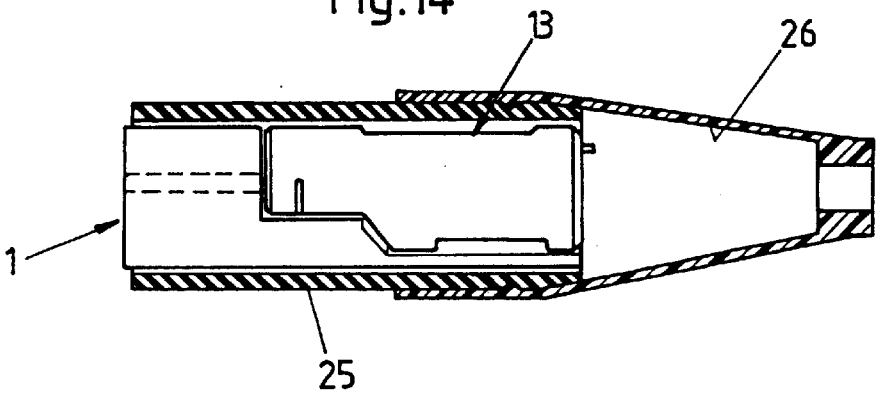
FIG. 14 shows a longitudinal section through a cable connector with the two-part connector insert.

For assembly, the strands of the cable to be connected, not shown, are exposed and the cable shielding is bent back and the insulation on the stranded wires can be left intact. The strands which are thus exposed, but still insulated, are placed on the wedge-shaped notches of the connection plates 7 (FIG. 4). The second part 13 is then advanced toward the first part 1 in a position such that it is inclined relative to the longitudinal axis of the first part 1, and the rear, undercut ends 24 of part 13 are attached to the rear end of the guide strips 11 of the channel-like portion 5 and this part is subsequently swiveled into an axially parallel position relative to part 1. In so doing, the shoulder 18 presses the strands to be connected into the slit connection plates 7, and the swivel jaw 14 at the same time acts on the cable and presses it against the insert 8, so that the ground connection is produced via the exposed shielding of the cable which contacts this insert 8. The two parts 1 and 13 which are connected with one another now only need to be inserted into the connector housing 25 and fastened therein. A cable sleeve 26 is then placed on it (FIG. 14).

When the insert 8 is constructed so as to be strip-shaped in the manner illustrated and described with reference to FIGS. 1 to 5, it contacts the freed cable shielding of the connected cable on one side. If especially strict demands are made on the shielding as in the case of the transmission or transfer of high-frequency signals, it is advisable to use an insert 8 such as that shown in FIGS. 15 or 16. An insert 8 serving as ground contact in this way encloses the exposed shielding of the connected cable almost entirely.

The swivel jaw 14 serving as pull relief is displaceable to some extent in the longitudinal direction of the cable connector by means of the continuation 16. By means of this displacement, the contact pressure force of the swivel jaw against the cable to be connected can be adjusted. In the shown embodiment example, part 13 is swiveled against part 1 during assembly. It is possible and lies within the framework of the invention to form the connection ends of the contact elements 3 in a conventional manner as solder lugs which extend substantially parallel to the longitudinal axis of the cable connector. In this case, the part 13 can be placed on part 1 in the manner of a slide or carriage, wherein the guide strips 11 form the required positive engagement.

Figure 17:
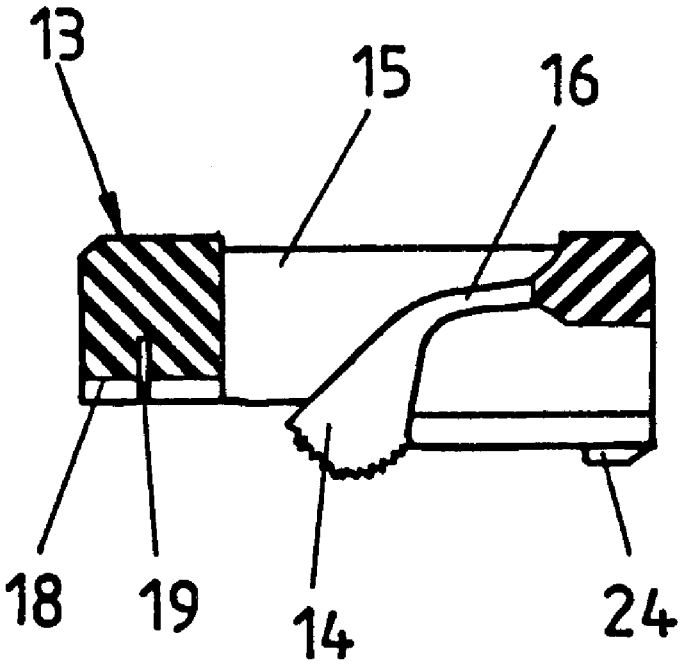
FIG. 17 shows, corresponding to FIG. 8, a longitudinal section through a modified embodiment example of the second part of the connector insert.

In a preferred, somewhat simplified embodiment example, the continuation 16 of the swivel jaw 14 can also be constructed in one piece with the second part carrying it, as is shown in FIG. 17.

While the foregoing description and drawings represent the preferred embodiments of the present invention, it will be obvious to those skilled in the art that various changes and modifications may be made therein without departing from the true spirit and scope of the present invention.

Reference Numbers

1 first part
2 portion
3 contact element
4 rear side
5 channel-like portion
6 ramp-like projection
7 connection plate
8 insert
9 notch
10 tongue-like continuation
11 guide strip
12 insulation web
13 second part
14 swivel jaw
15 elongated opening
16 continuation
17 opening
18 shoulder
19 slit
20 cylindrical shell
21 cylindrical shell
22 elongated opening
23 shell half
24 undercut end
25 connector housing
26 cable sleeve

What is claimed is:

1. A cable connector for electrical connections, comprising: a connector housing;

at least one connector insert made of electrically insulating material and having electrical contact elements;

a pull relief for grasping a cable to be connected to said contact elements so as to clamp it;

said pull relief being formed by at least one swivel jaw, said swivel jaw having a surface which cooperates with said cable and which is rounded in an arc-shaped manner, said swivel jaw further having a swivel plane lying in or parallel to a longitudinal axis of the cable connector;

said connector insert being formed of at least two parts;

a first part of said connector insert having a portion having at least parts of said electrical contact elements and a channel-shaped portion adjoining a rear side of said portion;

a second part of said connector insert being connectable with said channel-shaped portion of said first part so as to form a cylindrically-shaped connector insert;

said channel-shaped portion adjoining the portion having the electrical contact elements and having an electrically conducting insert which extends at least over part of a length of said channel-shaped portion and which extends until the portion of said first part having the contact elements so as to form a shield contact or ground contact; and said swivel jaw being supported at said second part.

2. The cable connector according to claim 1, wherein the second party carrying said swivel jaw is constructed as a slide or carriage and can be placed on the channel-like portion.

3. The cable connector according to claim 1, wherein the electrically conducting insert has raised notches or impressions transverse to its longitudinal direction, wherein said raised notches or impressions have a wedge angle ascending from the plane of the insert, and the ascending slope of the wedge angles which follow one another in a longitudinal row is directed against the portion having the contact elements.

4. The cable connector according to claim 1, wherein said electrically conducting insert has a tongue-like continuation which projects into the portion having the contact elements and which forms the shield contact or ground contact relative to a mating connector.

5. The cable connector according to claim 1, wherein said second part of the connector insert has an axially parallel elongated opening, the width of said elongated opening being greater than the width of the swivel jaw that is partially received by said elongated opening.

6. The cable connector according to claim 1, wherein the axial length of said second part amounts to approximately two thirds of the axial length of the first part.

7. The cable connector according to claim 1, wherein said second part which possibly carries said swivel jaw can be attached to said first part, preferably at the rear end of said first part, and is swivelable against the channel-like portion.

8. The cable connector according to claim 1, wherein said electrically conducting insert is formed of at least two cylindrically- shaped shells which are connected with one another and are swivelable against one another about their longitudinal axis to form a tubular portion, wherein the notches or impressions are formed in one shell and an elongated opening is cut out of the other shell to allow the passage of said swivel jaw.

9. The cable connector according to claim 1, wherein the essentially channel-shaped second part has, at the side facing the portion having the contact elements, a cross section-filling shoulder which has at least one slit extending transverse to the channel-shaped part, the slit connection plates projecting into this slit.

10. The cable connector according to claim 1, wherein the swivel jaw is formed in one part with the second part carrying said swivel jaw.

11. The cable connector of claim 1 wherein the surface of said swivel jaw is formed with teeth.

12. The cable connector according to claim 1, wherein connection plates in an electrically conducting connection with the connector contacts are arranged at the rear side of the portion having the contact elements and are slit at a distance from said contact elements and are disposed essentially at right angles to the longitudinal axis of the cable connector.

13. The cable connector according to claim 12, wherein the slit connection plates are arranged in a ramp-like projection at the rear side of the portion having said contact elements.

14. A cable connector for electrical connections comprising: a connector housing; at least one connector insert made of electrically insulating material and having electrical contact elements; a pull relief for grasping a cable to be connected to said contact elements so as to clamp it; said pull relief being formed by at least one swivel jaw said swivel jaw having a surface which cooperates with said cable and which is rounded in an arc-shaped manner, said swivel jaw further having a swivel plane lying in or parallel to a longitudinal axis of the cable connector; said connector insert being formed of at least two parts; a first part of said connector insert having a portion having at least parts of said electrical contact elements and a channel-shaped portion adjoining a rear side of said portion; a second part of said connector insert being connectable with said channel-shaped portion of said first part so as to form a cylindrically-shaped connector insert; said channel-shaped portion adjoining the portion having the electrical contact elements having an electrically conducting insert which extends at least over part of the length of said channel-shaped portion and which extends until the portion of said first part having the contact elements so as to form a shield contact or ground contact; said swivel jaw being supported at said second part; said swivel jaw having a continuation which extends essentially parallel to a longitudinal axis of the cable connector, said swivel jaw being supported at the second part via the continuation.

15. The cable connector according to claim 14, wherein the continuation of said swivel jaw is displaceable in the opening receiving said continuation.

16. The cable connector according to claim 15, wherein the continuation of the swivel jaw is directed against the rear end of the connector insert.

17. The cable connector according to claim 14, wherein the continuation of said swivel jaw is received by a slit-like opening corresponding to the cross section of the continuation.

18. The cable corrector according to claim 17, wherein the width of said swivel jaw and the width of its continuation are approximately equal.

* * * * *